United States Patent [19]

Smeggil et al.

[11] 4,389,463

[45] Jun. 21, 1983

[54] ZINC-ALUMINUM HOT DIP COATED FERROUS ARTICLE

[75] Inventors: John G. Smeggil, Simsbury; Norman S. Bornstein, West Hartford, both of Conn.

[73] Assignee: United Technologies Corporation, Hartford, Conn.

[21] Appl. No.: 286,128

[22] Filed: Jul. 23, 1981

[51] Int. Cl.[3] ..... C23C 1/02; C22C 18/04

[52] U.S. Cl. ..... 428/659; 420/514

[58] Field of Search ..... 428/659; 75/178 A; 427/433; 420/514

[56] References Cited

U.S. PATENT DOCUMENTS

| | | | |
|---|---|---|---|
| 3,320,040 | 5/1967 | Roe et al. | 428/659 |
| 3,343,930 | 9/1967 | Borzillo et al. | 428/659 |
| 3,393,089 | 7/1968 | Borzillo et al. | 75/178 A |
| 3,505,043 | 4/1970 | Lee et al. | 438/659 |
| 3,782,909 | 1/1974 | Cleary et al. | 428/659 |
| 3,952,120 | 4/1976 | Horton et al. | 427/433 |
| 4,029,478 | 6/1977 | Lee | 428/659 |
| 4,042,731 | 8/1977 | Chay | 427/433 X |
| 4,056,366 | 11/1977 | Lee et al. | 75/178 A |
| 4,056,657 | 11/1977 | Leckie et al. | 428/659 |
| 4,128,676 | 12/1978 | Lee | 427/433 |

FOREIGN PATENT DOCUMENTS

| | | | |
|---|---|---|---|
| 614996 | 5/1935 | Fed. Rep. of Germany | 75/178 A |
| 730402 | 7/1931 | France | 75/178 A |
| 41284 | 1/1932 | France | 75/178 A |

OTHER PUBLICATIONS

J. B. Horton, "Aluminum-Zinc Alloys as Sacrificial Coatings", Lehigh University, 1978.

*Primary Examiner*—L. Dewayne Rutledge
*Assistant Examiner*—David A. Hey
*Attorney, Agent, or Firm*—C. G. Nessler

[57] ABSTRACT

An improved hot dip coating of the zinc aluminum type contains germanium (Ge). In Zn-10Al coatings the addition of 0.1-1.2 Ge weight percent increases the fluidity of the molten metal in the bath and thereby enables substantially thinner coatings having more refined phase structure. Silicon (Si) is found to exhibit an analogous effect, but it not as powerful as Ge. Improved coatings contain zinc, 7-17Al, and 0.1-3(Ge+Si), where Ge ranges from 0-1.2, all weight percent.

11 Claims, 5 Drawing Figures

ZINC-ALUMINUM HOT DIP COATED FERROUS ARTICLE

BACKGROUND ART

The present invention relates to sacrificial coatings for ferrous metals, most particularly to hot dipped zinc base coatings containing substantial amounts of aluminum.

To produce hot dipped galvanized material, such as sheet or tubing, a metal article is immersed into a molten bath for a time sufficient to provide thereon a coating upon removal. Good coatings are characterized by a relatively superficial interaction, but good adherence, between the zinc metal of the molten bath and the metal article surface. Typically, zinc bath temperatures are held in the range of 440°–465° C. Higher temperatures increase bath fluidity and give better drainage of the excess hot dip coating material, thereby allowing thinner and more controlled coating thickness. But temperatures above 480° C. are avoided because they tend to result in oxidation of the melt and harmful attack of the typical ferrous metal bath container. Other negative aspects are increased time for the coating to solidify and increased energy losses.

Lead and iron are normal impurities in commercial zinc. In addition, the zinc base hot dipped coatings of the prior art contain various alloying metals to improve the coating process or properties. Among the metals which have been controllably added are lead, tin, aluminum, cadmium, antimony, and magnesium. Tin, lead, and antimony are often used to affect spangle formation. Aluminum is a particularly desirable coating element, since it greatly enhances corrosion resistance. In addition small quantities of aluminum tend to lower melt temperature and inhibit the reaction between the coating material and the ferrous substrate or container. Of course, for amounts of aluminum over 10% the bath temperature is increased, and the foregoing advantages can be countered.

Roe et al. U.S. Pat. No. 3,320,040 states that aluminum controls the thickness of the intermetallic layer between the coating and the substrate. Above 3.5Al (all quantities herein refer to weight percent), it is indicated that the intermetallic layer was too thin, resulting in poor coating adherence. Leckie et al. U.S. Pat. No. 4,056,657 discloses the coating alloy Zn-5Al, together with an additive comprised of 0.1% of the material selected from the group of Pb, Sb, and Sn. For Zn-5Al alone, there is dross and the difficulty in getting a bright, smooth ripple free, properly spangled, surface. Lackie et al. states that lead reduces ripple but increases spangle size. But if aluminum is maintained within 5±0.5 weight percent, 0.1% additive provides a formable coating having a good corrosion resistance.

High percentages of aluminum, from 3 to 17%, are disclosed in Lee et al. U.S. Pat. No. 3,505,043. In addition, the coatings contain 1.5 magnesium. Lee et al. U.S. Pat. No. 4,056,366 indicates how lead above 0.06 controls spangle formation in 0.2–17Al zinc base coatings. But, lead greater than 0.02 causes separation of the coating during deformation, after a coated article has been exposed to moist atmospheres; this is associated with intergranular attack of the coating. Improved coatings result when the lead content is maintained below 0.02 and antimony is present in amounts of about 0.15. Lee U.S. Pat. Nos. 4,039,478 and 4,128,676 mention the same problems and provide a different solution, comprising the inclusion of 0.1–0.15 of the magnesium. With this composition lead contents up to about 0.15 are tolerable. Borzillo U.S. Pat. No. 3,343,930 and Horton U.S. Pat. No. 3,952,120 generally disclose the value of silicon addition of 0.5–3% in zinc base coatings containing more than 25%Al. Silicon controls reactions at the coating and substrate interface in slow-cooling massive workpieces.

The prior art shows that compositions of zinc aluminum hot dip coatings can be relatively critical; there are certain known effects, but interactions between the diverse elements do not make optimum compositions easily deducible. The prior art of additives is largely concerned with adhesion and physical surface condition, while maintaining good corrosion resistance. Zinc aluminum sacrificial coatings provide protection by chemical action; in general, the greater the quantity or thickness present, the longer is the protective life. However, in some applications only very thin coatings are needed, and there is an economic incentive to controllably provide them.

DISCLOSURE OF THE INVENTION

An object of the invention is to provide, on ferrous metal articles, a hot dip zinc alloy coating which is corrosion resistant and especially adapted for application as a thin uniform layer.

Accordingly to the invention, inclusion of germanium in the hot dip coating bath provides improved fluidity to the coating, and thereby enables thinner and more uniform hot dip coatings to be applied. Embodiments of the invention include coatings with weight percent 4–17Al, 0.1–1.2Ge, balance Zn; more preferably 7–13Al, 0.1–1Ge, balance Zn; more preferably 9–11Al, 0.1–0.3Ge, balance Zn. Silicon is found to have a similar effect in amounts of 0.1–3 weight percent. The silicon may be used with or without germanium. However, it is found that germanium is much more powerful than silicon in producing the desired effects. Other elements may be present as well in the inventive aluminum zinc coatings, as are taught in the prior art, to provide other advantages to hot dip coatings.

Coatings of Zn-10Al typically have a microstructure comprised of alpha (aluminum rich) phase islands in an beta (zinc rich) matrix. The inclusion of a fluidity enhancer, such as germanium or silicon, dramatically reduces the alpha phase size. This is advantageous for corrosion resistance.

When germanium or silicon is included in the molten bath, there is more flexibility in choice of operation temperature. In the best practice of the invention, a clean substrate material of steel is immersed into the molten bath at a temperature in the range 400°–650° C.; the bath is covered with a molten halide flux to aid in providing a clean surface and preventing bath oxidation.

Salt corrosion tests show that a Zn-10Al-1Ge coating of the invention is found to provide very good corrosion resistance, at least comparable to Zn-10Al, which is in itself superior to plain zinc.

The foregoing and other objects, features and advantages of the present invention will become more apparent from the following description of preferred embodiments and accompanying drawings.

BEST MODE FOR CARRYING OUT THE INVENTION

Figure 1:
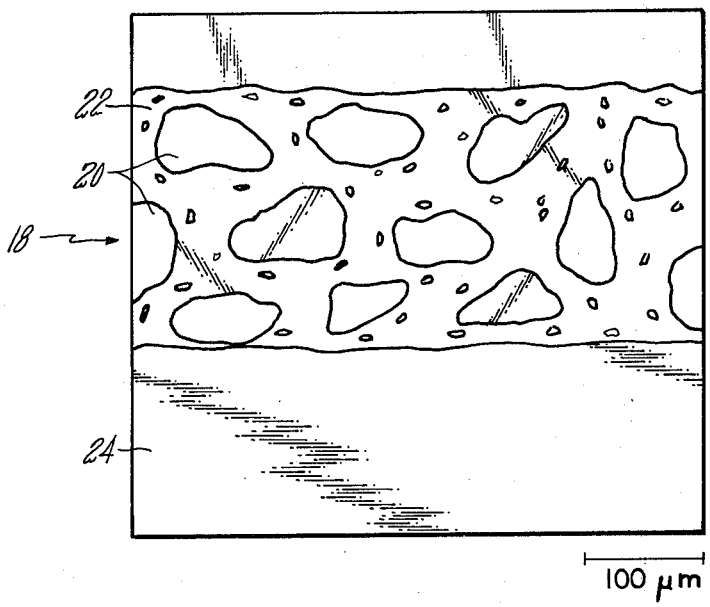
FIG. 1 is a line drawing showing in cross section the Zn-10Al coating microstructure on a steel substrate.

The invention is described in terms of bath dipping of ferrous metal articles. The inventive coating was especially developed for imparting corrosion resistance to the external surfaces of thin gage mild steel tubing, such as is commonly used in the automotive industry. Naturally, such tubing will be best produced on continuous hot dip coating line, as is well-known for applying both terne (lead-tin alloy) coatings and zinc alloy coatings. While the invention is here described in terms of applying especially thin coatings to the surfaces of metal tubing, it will be seen to be applicable to other coating applications and, other forms of ferrous materials, including strip, sheet and the like.

Zinc base coatings were applied to mild steel specimens. Mostly the zinc used in the experiments was by weight percent 99.99 min. Zn, <0.001Cd, <0.003Pb, <0.001Fe; 99.99 min. Al, <0.003Pb; silicon and germanium were commercially pure. Some commercial Zn-10Al alloy was also used. There was no special control of minor impurities, and the invention is believed useful at least with commercial alloys having up to one percent unwanted impurities.

Coatings were applied by dipping freshly cleaned (with acid) tubing specimens (9 mm O.D. ×7 mm I.D. ×25 mm long) into molten baths at temperatures of about 550° C. The baths were contained in alumina crucibles, covered with a molten halide flux, specifically, Dutch Boy 350 flux (Taracorp, Granite City, Ill.), containing various chlorides. Taracorp 360, a predominately zinc chloride flux, was also found usable. Immersion time was varied in the range 5–60 seconds, but mostly was about 5 seconds. As each specimen was removed from the bath it was vigorously shaken manually, to cause excess coating material to be discharged. Thus, the excess coating is removed by inertial forces. The coating thickness varied according to the bath composition and temperature, as set forth below. Coatings thicknesses were in the range $2\text{–}300\times10^{-6}$ m.

The zinc base coatings which were evaluated included those listed in Table 1. For comparative purposes some terne coatings were formulated as well. In addition to general visual observation, selected coatings were evaluated metallographically and in corrosion tests. The corrosion tests were conducted in accord generally with ASTM B117–73. Some specimens were evaluated with a full coating, inside and out, while others had a stripe of exposed tubing substrate about 3–4 mm wide along the external length (designated by (S) in the table below).

Corrosion test data are shown in Table 2. As expected, the zinc containing coatings were shown to be clearly superior to the terne coating, with and without a zinc filled polyurethane overcoat, which is presently in common use. As suggested by the prior art, the aluminum containing zinc base coatings were superior in great degree over the plain zinc coatings.

Significant amounts of aluminum must be present to produce a strong benefit. Although Zn-5Al (all compositions herein are by weight percent) is a preferred composition because it has a lower melting point than other Zn-Al alloys, corrosion tests of 0, 5, and 10 percent Al showed that higher percentages of Al were preferred. Generally compositions between 7–17Al are useful; with amounts less than about 7Al there was inferior corrosion resistance; above 17Al, free Al tends to be present making such coatings less desirable for corrosion resistance.

TABLE 1

| Coating Compositions |
|---|
| Zn |
| Zn-5Al |
| Zn-10Al |
| Zn-10Al-0.1Ge |
| Zn-10Al-0.3Ge |
| Zn-10Al-0.5Ge |
| Zn-10Al-1.0Ge |
| Zn-10Al-1.5Ge |
| Zn-10Al-2.0Ge |
| Zn-10Al-0.5Si |
| Zn-10Al-1.0Si |
| Zn-10Al-1.5Si |
| Zn-10Al-0.5Si-0.1Ge |
| Zn-10Al-1.5Si-0.1Ge |

TABLE 2

| | Coating Corrosion Tests | |
|---|---|---|
| Coating-Wt. % | Life-Hrs. | Comment |
| 15Sn-85Pb | <170 | Coating mostly gone; substrate attack |
| 15Sn-85Pb,(S) | <170 | Coating mostly gone; substrate attack |
| 15Sn-85Pb + Zn-filled polyurethane | <430 | Coating mostly gone; substrate attack |
| 15Sn-85Pb + Zn-filled polyurethane,(S) | <430 | Coating mostly gone; substrate attack |
| Zn | <400 | Coating mostly gone; substrate attack |
| Zn-5Al | <400 | Coating partially failed |
| Zn-10Al | >530 | Coating intact |
| Zn-10Al,(S) | >530 | Coating intact, no substrate attack |
| Zn-10Al-1Ge | >530 | Coating intact |
| Zn-10Al-1Ge,(S) | >530 | Coating intact, no substrate attack |

(S) = exposed strip of substrate on specimen.

It is preferred to have aluminum contents at the lower end of the range since the coating melting point is lower. The most preferred composition contained about 10Al.

Figure 2:
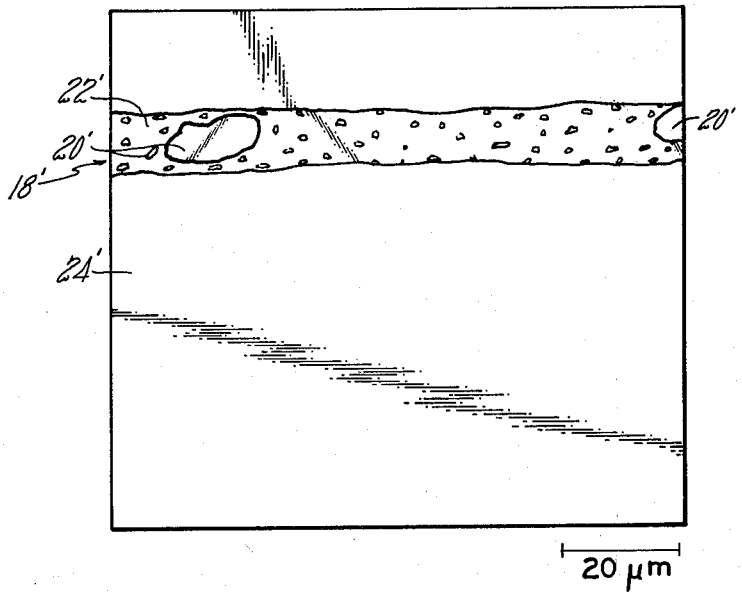
FIG. 2, similar to FIG. 1, shows a Zn-10Al-1Ge coating on a steel substrate.

In the testing, coatings of pure zinc and Zn-5Al failed in less than 400 hours while the coatings containing 10 weight percent Al showed no evidence of failure at 530 hours. Experiments were conducted using the element germanium (Ge), and the Zn-10Al alloy. The addition of one percent Ge to the Zn-10Al visibly produced enhanced fluidity at 500°–550° C., thereby making easier the providing of a thinner coating. Metallographic studies graphically illustrate the advantage of Zn-10Al-1Ge compared to Zn-10Al. The specimens were prepared by polishing without etching and observed in a scanning electron microscope. FIG. 1 is a line drawing showing the morphology of a Zn-10Al coating 18 applied from a bath at 500° C. Aluminum rich alpha phase islands 20 are contained within a zinc rich beta phase matrix 22, which is adhered to the steel substrate 24. FIG. 2 shows a Zn-10Al-1Ge coating applied with similar bath conditions. Number designations and features are analogous to those for FIG. 1. FIG. 1 shows the Zn-10Al-1Ge coating thickness is greatly decreased, to about $19\times10^{-3}$ mm from about $240\times10^{-3}$ mm for Zn-10Al in FIG. 1. This is a manifestation of greater fluidity. In addition, measurement shows that the aluminum rich alpha phase size of the Zn-10Al coating is about $20\times10^{-6}$ m, whereas the characteristic phase size in the Zn-10Al-1Ge coating is typically of the order of $1\text{-}2\times10^{-6}$ m, with the maximum size observed to be about $15\times10^{-6}$m. The fine phase size of Zn-10Al-1Ge is desirable, according to general principles for corrosion resisting coatings. It increases the surface area of a desirable constituent, in this instance, the alpha phase.

Figure 3:
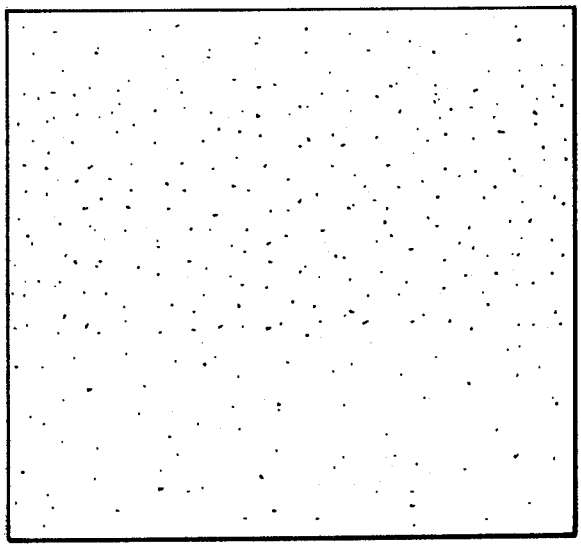
FIGS. 3 and 4 are line drawings of the threshold intensity image produced when x-rays emanate from the surface of the specimens of FIGS. 1 and 2, respectively, indicating in black where Ge is concentrated.
Figure 4:
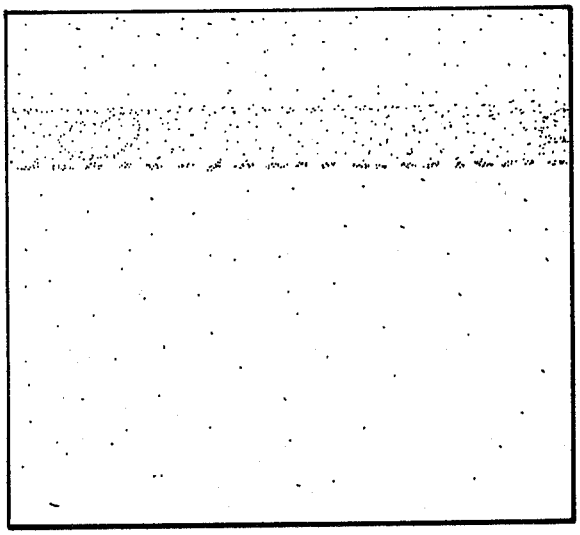

Coatings were also examined using "Energy Dispersive Analysis by X-ray" (EDAX) with a Cameca MBX Microprobe (Cameca Instrument, Inc., Elmsford, N.Y.). The technique is useful in identifying element concentration on the surface of a specimen. The resultant "x-ray maps" for Ge in the Zn-10Al and Zn-10Al-1Ge specimens shown in FIGS. 1 and 2 are schematically illustrated in FIGS. 3 and 4, respectively. Of course, inasmuch as there was no intended Ge in the coating of FIG. 1, the x-ray map shows only background noise. Referring to FIG. 4, it is seen that Ge concentrations 26 are present at the boundary between the coating 18' and the steel substrate 24'. This is an interesting observation which is believed valid, but the causative mechanisms are not fully understood at present. One speculation is that Ge migrates through the rather thin coating as the coating solidifies from the convectively cooled exterior surface, toward the hot substrate. Comparison of the coating as a whole, with the substrate (background level) indicates there is Ge dispersed in the coating. Since Ge is insoluble in Zn but soluble in Al, the Ge is most likely present in the alpha phase. There is no metallographic evidence of precipitation of Ge in the alpha phase at the 1 weight percent level.

Additional Zn-10Al coatings were made with Ge contents between 0.1 and 2 weight percent. Improved fluidity was observed throughout the range; it is especially notable that the lowest 0.1% level of Ge qualitatively gave a fluidity enhancement of the same magnitude as the 1% level. While levels above 2%Ge were not tested, according to available phase diagrams, Ge is soluble in Al up to 7.2 weight percent at 424° C., and not in Zn. Therefore in Zn-10Al the maximun Ge content would be of the order of 0.7 weight percent; for Zn-7Al, about 0.5, and for Zn-17Al about 1.2. But since Ge is expensive, there is an incentive to prefer lower Ge contents.

Aluminum up to 7% depresses the melting point of zinc; germanium up to 70% depresses the melting point of aluminum. Therefore it can be deduced that the combined effects if Al and Ge will be to lower melting points. The lower melting point will result in increased fluidity at a given melt temperature, and a more preferred coating alloy.

Combining the foregoing observations, the broadest embodiment of the inventive zinc base alloys contain 4–17Al in combination with at least 0.1Ge; up to 1.2Ge may be included. Preferred are alloys having 7–13Al and 0.1–1.0Ge; most preferred are alloys containing 9–11Al and 0.1–0.3Ge. The foregoing compositions are reflective of the desire to lower Al contents to lower melting points and to lower Ge to minimize cost. Based on the principles we allude to, it is believed the effects of Ge will be evident in other composition alloy coatings based on Zn which contain Al. Included in these are coatings having other alloying elements, mentioned in the background section, the disclosures of which we incorporate by this reference; also included of course are impurities present in commercial alloys which do not affect the essential features of the inventive compositions.

The scope of our effort did not enable us to ascertain if exactly the same Ge contents are attained in the coating as in the bath, although we believe this to be the case. Of course, owing to the concentration of Ge near the substrate surface, the coated article composition of our invention will be a reference to the average composition of the coating.

As mentioned our coatings were applied with a chloride flux floating on the molten metal bath. It would appear that other protective covers which prevent oxidation may be used as well. The temperature of our bath may be varied according to choice of the user. For reasons set forth previously, it is desirable to minimize the bath temperature so long as adequate fluidity is obtained. With our preferred compositions, temperatures of 400° to 650° C. are believed usable, with 475° to 550° C. being preferred.

In preparing a substrate for hot dip coating the substrate surface should be clean, and may be pretreated by oxidation-reduction, flux immersion, or other known methods.

As indicated by Table 1, Zn-10Al coatings were also made with silicon addition, with and without Ge. Silicon in the range 0.5–1.5 had an effect on fluidity analogous to that of Ge, when compared on a weight percent basis. However, when compared on an atomic weight basis, it is seen that Ge is much more powerful than Si.

Figure 5:
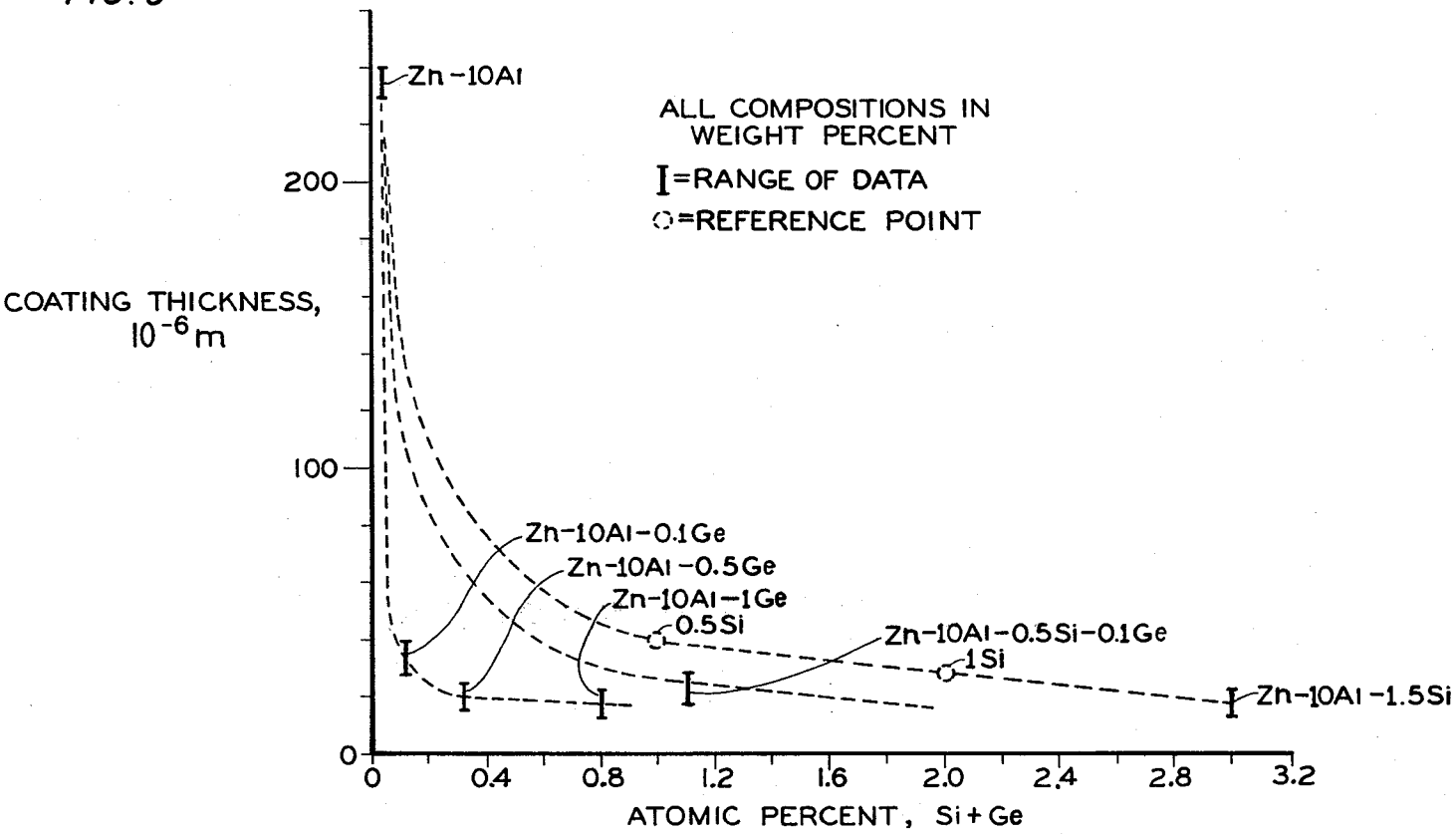
FIG. 5 is a graph showing the effects of different atomic amounts of germanium and silicon on coating thickness.

Referring to FIG. 5, the effect on thickness of Zn-10Al base coatings is seen for various atomic and weight amounts of Si and Ge additive. The thickness is that produced on a specimen immersed in a bath at 550° C., according to the procedures set forth above. First, the comparatively powerful effect of Ge is seen: relatively small amounts of Ge reduce coating thickness by a factor of 6 to 20, compared to the base Zn-10Al coating. Second, Si also reduces coating thickness considerably. Third, a datum for Zn-10Al-0.5Si-0.1Ge is shown, together with the curve for Zn-10Al-Si-Ge, where the ratio of Si to Ge is 5:1. It is seen that the Zn-Al-Si-Ge coating tends to be thinner than the Zn-Al-Si coating. In another comparison, the thickness of Zn-10Al-0.5Si-0.1Ge coating is less than the 0.1Ge coating. Comparing Ge with Si, to obtain the same reduction in thickness, only one-third the number of Ge atoms is required. It is advantageous from a corrosion standpoint to have the minimum number of additive atoms. Phase diagrams show Si has limited solubility in both Al and Zn, compared to the substantially solubility of Ge in Al. Therefore, Ge is preferred over Si. And, a small amount of Ge may be combined with Si to enable reduction in the total Si content, when it is desired to use Si for cost reasons. Alternatively stated, the use of an additive of (Ge+Si) necessitates less weight and atomic percent additive than the use of Si alone.

Based on the foregoing and general considerations, 0.1 to 3Si is believed useful, with 0.1–1.5Si being preferred, in zinc base coatings with 7 to 17Al. The preferred limits of Al in Si containing coatings will be the same as set forth above for Zn-Al-Ge coatings. With such Zn-Al-Si coatings, Ge may be included additionally or substitutionally for Si, in the range 0.1–1.2 weight percent. The preferred Ge contents are also as set forth above for Zn-Al-Ge coatings.

The use of 0–3Si for the purpose of enabling thin hot dip coatings does not appear revealed in the prior art. In the art cited herein, silicon has only been used in Zn base coatings having greater than 25Al, for other reasons. Simple binary phase diagrams demonstrate that zinc coatings of 7–17Al have a different structure from zinc coatings having 25+Al, and therefore we believe our use of Si, with or without Ge, to be novel.

Electron microprobe study of Zn-10Al-Si coatings shows a fine alpha phase size, similar to the results described for FIG. 2. As mentioned, this is advantageous from a corrosion standpoint. The fine phase size characteristic is probably largely a function of the higher cooling rate experienced by the thinner coatings. The fluidity enhancing properties of Si and Ge enable the thinner coating. Other elements which also produce increased fluidity, to the degree produced by 0.1–3(Si+Ge), would enable similar desirable coatings. The coatings are described by their property, produced when they are applied from a bath at about 550° C. to a small workpiece, such as the tubing specimen, according to the procedures set forth above, that is, inertial wiping. Under such conditions they will be characterized by an alpha phase smaller than $15\times10^{-6}$ m, and predominately of the order of $1\text{–}2\times10^{-6}$ m. The property just described is that which is measurable under the test conditions set forth, and thus characterizes the invention. Such refined phase sizes may be produced in a non-inventive coating, such as Zn-10Al, but only when the coating is artificially cooled, as by a steam or airblast. When artificial cooling is used, the inventive coatings will still produce improved coatings compared to those of the prior art. Thinner coatings with somewhat more refined phase size will result.

The invention is particularly adapted for applying a coating continuously in the manufacture of steel tubing. To accomplish this in a preferred mode, a steel strip is appropriately cleaned to remove extraneous dirt and the like; formed and welded to a tube shape; and dressed as necessary to remove weld flash; and heat treated in a reducing atmosphere. It is thereupon passed through a flux such as is used to protect the molten metal bath, to clean the surface. The tubing is next passed through the hot molten coating bath at a speed which enables the bath to heat the tubing and wet the surface, thereby allowing quantity of liquid coating metal to adhere to the tubing as it is withdrawn from the bath. As it is withdrawn from the bath, the tubing is wiped with jets of air heated to about 500° C., to physically remove excess metal. The tubing is then convectively cooled and recoiled or otherwise further processed, as desired.

Although this invention has been shown and described with respect to a preferred embodiment, it will be understood by those skilled in the art that various changes in form and detail thereof may be made without departing from the spirit and scope of the claimed invention.

We claim:

1. A ferrous metal article having on the surface thereof a hot dip coating comprised predominantly of zinc (Zn), up to 17 weight percent aluminum (Al), and at least 0.1 weight percent germanium (Ge).

2. The article of claim 1 wherein the coating is more particularly characterized by weight percent as 4–17Al, 0.1–1.2Ge, balance Zn.

3. The article of claim 2 wherein the coating is more particularly characterized as 7–13Al, 0.1–1Ge balance Zn.

4. The article of claim 3 wherein the coating consists essentially of 9–11Al, 0.1–0.3Ge, balance Zn.

5. The article of claims 1, 2, 3 or 4, said coating containing 0.1–3 weight percent silicon (Si) in substitution for Zn.

6. The article of claims 1, 2 or 3 having a nominal alpha (aluminum rich) phase of a size of less than about $15\times10^{-6}$ m in dimension when applied to a small ferrous workpiece using inertial removal of excess hot dip coating.

7. The article of claim 6 wherein the alpha phase size is predominantely of the order of $1\text{–}2\times10^{-6}$ m.

8. In the method of applying zinc aluminum alloy coatings to articles by hot dipping, the improvement which comprises adding 0.1–1.2 weight percent germanium to the molten coating bath.

9. The method of applying an improved zinc aluminum alloy coating on a ferrous metal article, characterized by passing the article through a molten zinc (Zn) base metal bath comprised by weight percent of 4–17 aluminum (Al); and 0.1–3 germanium+silicon (Ge+Si), wherein Ge ranges from 0.1–1.2.

10. The method of claim 9 wherein the molten bath is comprised of 7–13Al, 0.1–1(Ge+Si), balance Zn.

11. The methods of claims 8, 9, or 10 further characterized by covering of the molten coating bath into which the article is immersed with a molten halide flux, and holding the bath in the temperature range of 400° to 650° C.

* * * * *